US005551951A

United States Patent [19]

Fradkin

[11] Patent Number: 5,551,951

[45] Date of Patent: Sep. 3, 1996

[54] VEHICLE SEAT WITH MASSAGE DEVICE

[76] Inventor: Boris Fradkin, Rehov Hadas 9, Oranit, Israel

[21] Appl. No.: 332,116

[22] Filed: Oct. 31, 1994

[51] Int. Cl.[6] ..... A61H 15/00

[52] U.S. Cl. ..... 601/115; 601/122

[58] Field of Search ..... 601/115, 122, 601/124, 128, 134, 136, 143, 146, 147

[56] References Cited

U.S. PATENT DOCUMENTS

| | | | |
|---|---|---|---|
| 2,619,957 | 12/1952 | Hague | 601/122 |
| 2,840,072 | 6/1958 | Stearns | 601/115 |
| 4,113,246 | 9/1978 | Gibbs | 601/122 |
| 4,178,921 | 12/1979 | Kosiak | 601/122 |
| 5,105,490 | 4/1992 | Shek | 601/122 |
| 5,251,615 | 10/1993 | Sheen | 601/115 |

FOREIGN PATENT DOCUMENTS

| | | | |
|---|---|---|---|
| 1277964 | 12/1986 | U.S.S.R. | 601/122 |

*Primary Examiner*—Mickey Yu
*Assistant Examiner*—David J. Kenealy
*Attorney, Agent, or Firm*—Edward Langer

[57] ABSTRACT

An orthopaedic vehicle seat providing massaging characteristics for all body parts contacted by the seat, with the massage caused by the body movement relative to the orthopaedic vehicle chair.

5 Claims, 1 Drawing Sheet

VEHICLE SEAT WITH MASSAGE DEVICE

FIELD OF THE INVENTION

This invention relates to the field of equipment and elements of a vehicle, and in particular to seats (chairs) of vehicle drivers/passengers, and can be used for individuals who are seated or immobile for a long time.

BACKGROUND OF THE INVENTION

There are known seats (chairs) for vehicle drivers, as described in U.S. Pat. No. 2,922,416 to Fader, where, in order to reduce driver fatigue, a cylindrical roller is mounted into a special chair back casing. The cylindrical roller is moved by a connecting-rod mechanism (powered by a motor and reduction gear) and by reciprocating motion within flexible material, the seat supports a driver's back and provides some massaging to it.

Such a device is very complicated, needs tuning, has low reliability, and most importantly, does not provide comfort to the driver, i.e., does not massage the lower part of the body and does not provide ventilation.

Different massaging apparatus for vehicle seats are known, as described in U.S. Pat. No. 4,169,466 to Wong. In general, they comprise a relatively large number of massaging balls or beads, all of which are supported in a planar fashion between a double-walled support structure. One wall of the support structure has bead positioning cavities and the other wall has openings through which the beads extend.

The majority of the beads are of a first, smaller size, while a relatively few beads, located along a central axis, are of a larger size. Such apparatus preferably has support straps to support it on an automobile seat. This solution, usable by an automobile driver, relieves back ache or strain especially during a long trip.

This apparatus is relatively difficult to produce, and its massaging effect on the back is insufficient. In addition, it does not support the back and hence does not provide rear back relief and reduction of fatigue and does not provide back ventilation.

Another driver massage device is known and described in U.S. Pat. No. 4,936,294 to Chu. This device has a substantially planar support of foamed plastic and a plurality of massaging elements in the form of halves of balls distributed uniformly about the support. Such a device provides a more comfortable massage and is less expensive, but it has other disadvantages as outlined above in relation to the patent to Wong.

There are different ventilation devices, in particular for a seat in the form of a panel or grid fabricated as a sheet of resilient plastic material having a plurality of protuberances arranged in columns and rows which act to support the body in spaced relation to the supporting surface. Such a lattice of channels, formed by protuberances between the supporting surface and the body to provide ventilation, is described in U.S. Pat. No. 4,143,916 to Trotman et al.

The Trotman device is functionally restricted and, as is shown in the patent, cannot simply be combined (without additional finishing and completion) as an assembly for a driver back-supporting device which provides massaging of body parts.

U.S. Pat. No. 4,259,248 to Trotman et al. discloses a ventilation device useful as a seat pad with a lattice-type structured panel, padding material and a plurality of horizontal and vertical protuberances designed for ready passage of air. This device is more comfortable for a driver/passenger than that described above in the '916 Trotman device, but is has the same disadvantages.

Other devices for the above-mentioned purposes are known, as described in U.S. Pat. Nos. 3,137,523 to Karner, and 3,675,644 to Laskowitz, and UK Patent No. GB 2234439-A to Kato. These devices combine certain functions which are relevant for purposes of review of the prior art.

However, all of these devices do not solve completely all the problems for designing modern vehicle seats for drivers and passengers and for individuals who are seated or immobile for a long time (including sick people with restricted mobility). In such cases, the known technical means permit solving the problem, but the proposed devices may be too complicated, therefore they are not saleable, and there is not a great demand for such devices.

Therefore, the main purpose of the present invention was to provide an inexpensive vehicle seat with good operating parameters, leading to an improvement in vehicle driving comfort by reducing driver fatigue and ultimately, the number of traffic accidents.

Another purpose of the invention was to enlarge the field of users of such a seat, not only for drivers and passengers, but for individuals who are seated or immobile for a long time including sick people with restricted mobility.

SUMMARY OF THE INVENTION

The stated purpose of the present invention is achieved by the proposed vehicle seat which, as a rule, is settled on a supporting surface, and comprises two parts connected with a foldable joint, for example like a loop made of elastic material.

The upper part of the vehicle seat-back has a frame (typically metal) which is mainly rectangular. Two side ribs with length L(side) are bent at the distance of (0.3/0.5) L(side) from the lower rib to the backbone direction with an angle of 10°–30° from the vertical. To the side ribs are connected the rows of the horizontal, typically spring-resilient metallic rods. On each of them are rotatably disposed beads which are shaped in the form of a cylinder keg with rounded flats. The ratio between the outer diameter of the bead (DB) and the length of the side rib (Lside) is in the range as follows:

$$DB/Lside=0.035 \leftrightarrows 0.027$$

The lower part of the vehicle seat also has a frame which has the shape of an isosceles trapezium in vertical projection, with salient sides. The upper base of the trapezium is adequate to fit the small side of the seat-back, and the lower base of the trapezium in the middle is bent upwards towards the driver's legs. To the side ribs of the trapezium are connected the rows of the horizontal, typically spring-resilient metallic rods. On each of them the beads are rotatably disposed, like in the upper part of the vehicle seat.

The ratio between the outer diameter of the bead (DB) and the length of the side rib (Lside) is in the range as follows:

$$DB/Lside=0.040 \leftrightarrows 0.033$$

The ratio of the bead length (LB) and the width of the bead in the middle (HM) is in the range as follows:

$$LB/HM=0.045 \leftrightarrows 0.035$$

Such a design provides support, massaging and ventilation to the back and lower part of the driver's body.

In some cases, such a vehicle seat may be designed as a chair with a supporting base structure which permits adjustment of the chair's height, and allows horizontal movement of the chair's seat and adjustment of its inclination angle. The upper part of the seat/chair can be moved in a vertical direction and its inclination angle can be changed.

In this way, though the features of the proposed device are based on the known elements and methods of assembly in the whole system, they are integrally connected to the mathematical relationships of the main parameters established by the inventor, which as a whole defines totally new essential features, providing additional effects and making this a very useful device.

The known technical solution analysis confirms that the inventor of the present invention has made a valuable contribution to the development of an important direction of design, i.e., this device presents itself as an inventive step.

Because of the proposed technical design, this vehicle seat for drivers and passengers (or for the individuals who are seated or immobile for a long time: computer operators, secretary, designer etc. or sick people with restricted mobility) can adapt itself to the body lines of any of the above-mentioned individuals (adapting to back contour and supporting it). It also provides slow (comfortable) massage for tense back muscle relaxation, and improves the condition of a person who is suffering from pain and stagnant phenomenon in his back, waist and hips (about 80% of the population).

The vehicle seat provides maximum support to back, waist and hips and release from constant body pressure. The chair turns into a natural orthopaedic seat for an individual's freedom of sitting without becoming tense at any angle position, with free access of the air to the body parts contacted by the seat. As a result, maximum comfort is provided while sitting in the vehicle, at home, or in the office. The fatigue is reduced, and pain in the back, waist and hips is decreased providing the positive effect of the proposed device.

BRIEF DESCRIPTION OF THE DRAWINGS

For a better understanding of the invention, reference is now made to the drawings wherein the essence of the proposed invention is shown with emphasis on some of its main elements, in which.

DESCRIPTION OF THE PREFERRED EMBODIMENT

Figure 1:
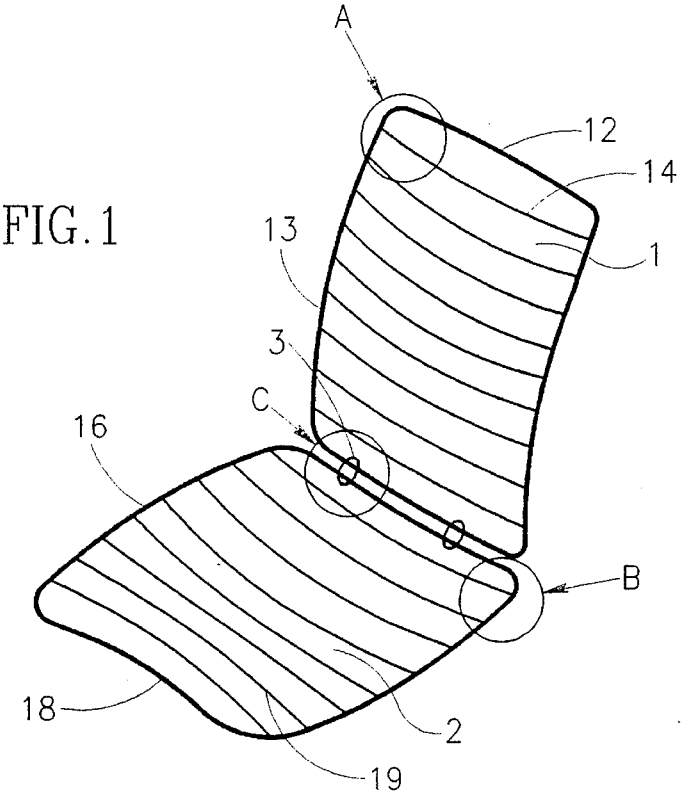
FIG. 1 is an overall view.
Figure 2:
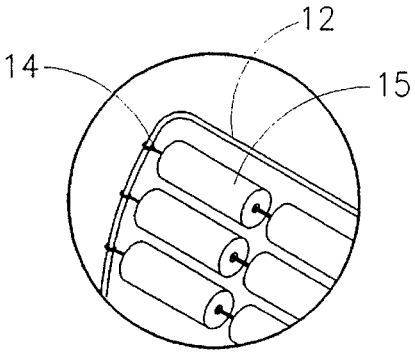
FIG. 2 is a detailed view of area A.
Figure 3:
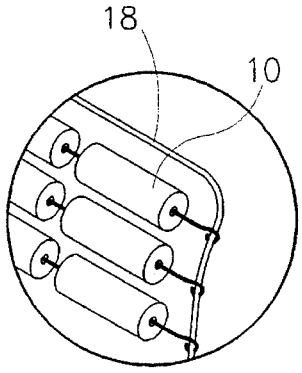
FIG. 3 is a detailed view of area B.
Figure 4:
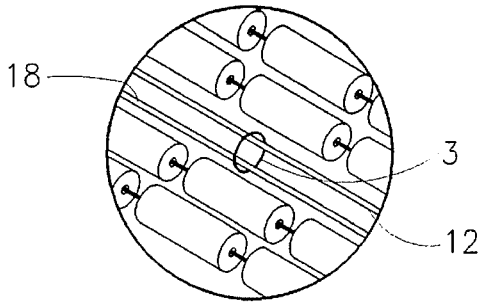
FIG. 4 is a detailed view of area C.

The proposed vehicle seat usually situated on the driver/passenger's chair of any vehicle, is assembled from three parts: an upper part, seat back 1; lower part, seat 2 and foldable joint 3. Detailed views of their elements are shown in FIGS. 2, 3 and 4 accordingly. Seat-back 1 and seat 2 are bound together by a foldable joint 3, for example a loop made of elastic material (it can also be a disconnectable or non-collapsible loop) which does not prevent the relative movement of seat-back 1 to the vehicle chair during shocks and bumps encountered during vehicle motion.

The upper part—seat-back 1 is assembled as a frame 12 (metallic, made of plastic, fiberglass, etc.) mainly rectangular, two side ribs 13 with length Lside which are curved at the distance of (0.3/0.5) Lside from the lower rib of the frame to the backbone of the driver/passenger's direction with a 10°–30° angle from the vertical. The frame 12 has rows of horizontal, typically spring-resilient metallic rods 14 (made from metal, plastic, fiberglass, etc.) firmly connected (soldered, welded or screwed etc.) to the side ribs 13. The metallic pivots 14 have rotatably disposed thereon beads 15, mainly shaped as a cylinder keg with rounded flats (may be shaped as a cask, ball, ellipsoid or other form of beads with individual chosen protuberances, etc.); the diameter of every bead 15 is related to the length of the side rib in the range as follows:

$$DB/Lside=0.033 \leftrightarrows 0.031$$

The lower seat part is also assembled as a frame 18 (metallic, made of plastic, fiberglass, etc.) which has the shape of an isosceles trapezium in vertical projection, with salient sides 16. The upper base of the trapezium is adequate to fit the small side of the upper part of seat-back 1, and the lower base 18 of the trapezium in the middle is bent upward towards the driver's leg. The frame 18 has rows of horizontal, typically spring-resilient metallic rods 19 like in the upper part of the vehicle seat described above, with beads 10 rotatably disposed thereon as described above. The diameter of every bead is related to the length of the middle width of the seat (HMS) in the range as follows:

$$DB/HMS=0.045 \leftrightarrows 0.035$$

From the technological point of view, it is advisable to use the same beads in seat-back 1 and seat 2 (i.e. DB=DBS and LB=LBS and made from the same material like wood or plastic). In the common case, the above-mentioned parameters may be different.

As a matter of principle, the proposed vehicle seat can be built strongly enough and in some cases (for different offices) can be used without a supporting chair, as it can be placed on its own support base which will be a part of the proposed chair. This support can change the position of its parts in space for comfort and convenience.

Main operational advantages of the proposed solution:

1. Orthopaedic shape, possibility of back support comfort—important especially for taxi, truck, autobus drivers, because of the long time during which they are in a sitting position. The possibility of comfort driving during a long period of time ultimately reduces the possibility of traffic accidents (because it reduces the fatigue of the driver, provides massage and thus improves blood circulation and reduces hemostasia and accordingly prevents such disease as sciatica); it improves the driver's critical conditions and enables the driver to pay more attention to what happens around him and hence to improve traffic safety.

2. It is very important that the proposed vehicle chair design provides it massaging characteristics for all body parts contacted by the chair; the massage in this special case is caused by the body movement relative to the orthopaedic vehicle chair.

3. The proposed design provides ventilation of the body parts contacted by the chair in a very simple way (the vehicle seat surface has spaces and clearances to permit free movement of the air), it causes good air exchange and reduces unpleasant skin sensation and even the possibility of skin diseases.

Other advantages (construction):

The proposed design provides automatic fixation (centering) of the upper part of the vehicle seat to the body contour owing to the possibility of relative movement between the seat-back and the supporting structure.

In the proposed design, the spring features of the horizontal rods with beads rotatably disposed thereon are essential and hence the spring features of all the supporting surfaces as a whole (which as a result provides automatic massage).

Another advantage is that the two parts of the vehicle seat, the seat-back 1 and seat 2 do not need to be necessarily fastened to the supporting structure, i.e., they can be fastened and fixed for a definite driver/person or they can remain in a condition of free adaptation to any driver/person.

The vehicle seat is washable, may be made of attractive colors and is compact.

What is claimed is:

1. An orthopaedic vehicle seat for providing driver/passenger massaging and ventilation comprising:

an upper seat-back portion having a rigid, rectangular frame defining a vertical plane with side frame portions bent at a point above its lower end approximately 0.3–0.5 of its height, so as to extend in arched fashion out of said vertical plane at an angle of 10–30 thereto, said upper portion frame enclosing a plurality of rows of horizontal, spring-resilient rigid rods connected thereto and extending along its width, each rod having rotatably disposed thereon a plurality of beads defining spaces therebetween, each of said beads being generally cylindrically-shaped; and a lower seat portion having a rigid frame defining a horizontal plane and being joined at its rear end to said upper seat-back portion by a foldable joint, said lower seat portion frame enclosing a plurality of rows of spring-resilient rigid rods connected thereto and extending along its width, said plurality of rows of rigid rods defining a seat contour gently upwardly arched out of said horizontal plane proximate the front end of said lower seat portion frame and gently depressed toward its rear end, each said rigid rod having rotatably disposed thereon a plurality of said beads defining spaces therebetween, such that when the vehicle seat is placed on a support base surface and a driver is seated thereon, said spring-resilient rigid rods thereof assume the contour of and support the driver's back, waist and hips, providing pressure while said beads massage said body parts and said spaces provide airflow for ventilation.

2. The vehicle seat of claim 1 further comprising loops of elastic material connected between said upper seat-back and lower seat portions, such that said upper seat-back and lower seat portions are movable vertically relative to each other.

3. The vehicle seat of claim 1 wherein said beads massage the driver in response to spring-resilient movement of said member rods relative to said frame, in accordance with relative body movement.

4. The vehicle seat of claim 1 wherein the inclination of said upper seat-back portion is adjustable relative to said lower seat portion.

5. The vehicle seat of claim 1 further comprising a support base for supporting it and providing height and inclination angle adjustment and horizontal movement.

* * * * *